US005615440A

United States Patent [19]

Cowan et al.

[11] Patent Number: 5,615,440

[45] Date of Patent: Apr. 1, 1997

[54] DISPOSABLE APPLICATOR

[75] Inventors: Michael I. Cowan; Jordan P. Weiss; Lisa A. Ziff, all of Los Angeles, Calif.

[73] Assignee: Radiant Products, Ltd.

[21] Appl. No.: 460,224

[22] Filed: Jun. 2, 1995

[51] Int. Cl.[6] ..... A61M 35/00; A47K 7/02; A47L 13/16

[52] U.S. Cl. ..... 15/104.94; 15/143.1; 15/209.1; 15/244.2; 604/1; 604/289

[58] Field of Search ..... 15/104.94, 244.2, 15/144.1, 143.1, 145, 104.93, 209.1, 210.1; 16/114 R, 110; 206/361, 362.4; 604/1, 310, 289

[56] References Cited

U.S. PATENT DOCUMENTS

| | | | |
|---|---|---|---|
| 2,323,098 | 6/1943 | Mintzes et al. . | |
| 2,975,453 | 3/1961 | Imhof | 15/244.1 |
| 3,064,301 | 11/1962 | Clor . | |
| 3,131,410 | 5/1964 | Anderson et al. | 15/244.1 |
| 3,142,855 | 8/1964 | Gilchrist | 15/143.1 |
| 3,299,464 | 1/1967 | O'Brien et al. . | |
| 3,737,939 | 6/1973 | Jones, Sr. | 15/143.1 |
| 3,784,998 | 1/1974 | Jones, Sr. . | |
| 4,053,242 | 10/1977 | Mast, Jr. | 15/104.94 |
| 4,077,725 | 3/1978 | Slautterback . | |
| 4,121,386 | 10/1978 | Perez | 15/209.1 |
| 4,519,795 | 5/1985 | Hitchcock, Jr. et al. | 604/310 |
| 4,575,891 | 3/1986 | Valente | 15/104.93 |
| 4,641,391 | 2/1987 | De brey | 15/104.94 |
| 4,701,168 | 10/1987 | Gammons | 604/1 |
| 4,708,507 | 11/1987 | von Schuckmann . | |
| 4,715,496 | 12/1987 | Hackmann . | |
| 4,893,956 | 1/1990 | Wojcik et al. | 15/104.94 |
| 5,020,930 | 6/1991 | Kuhn . | |
| 5,112,152 | 5/1992 | McBride . | |
| 5,188,472 | 2/1991 | Sgro . | |
| 5,230,119 | 7/1993 | Woods et al. | 15/104.94 |
| 5,242,232 | 9/1993 | Kuhn . | |

FOREIGN PATENT DOCUMENTS

| | | | |
|---|---|---|---|
| 4609 | of 1915 | United Kingdom | 15/209.1 |
| 6160 | of 1916 | United Kingdom | 15/209.1 |

*Primary Examiner*—David Scherbel
*Assistant Examiner*—Tony G. Soohoo
*Attorney, Agent, or Firm*—Poms, Smith, Lande & Rose

[57] ABSTRACT

A disposable, hand-held, single-use applicator for applying waxes, polishes, medicines and other chemical compounds has a base piece and a chemically-impregnated pad attached to the lower surface of the base piece. The handle of the applicator has a first handle piece that is hingedly attached to the upper surface of the base piece, and a second handle piece that is not attached to the base piece. A swivel gap separates the second handle piece from the base piece. The base piece and pad may swivel at least somewhat relative to the first handle piece to adjust to the contour of the surface to which the chemical is being applied. The first and second handle pieces are collapsibly interconnected with one another such that the second handle piece may be rotated to a collapsed position in which the second handle piece is substantially juxtaposed to the first handle piece, with both handle pieces extending almost within the same plane. The handle pieces may then be folded together onto the base piece so that the applicator may be efficiently enclosed in plastic packaging or a thin box for sale in a vending machine.

24 Claims, 2 Drawing Sheets

FIG. 1
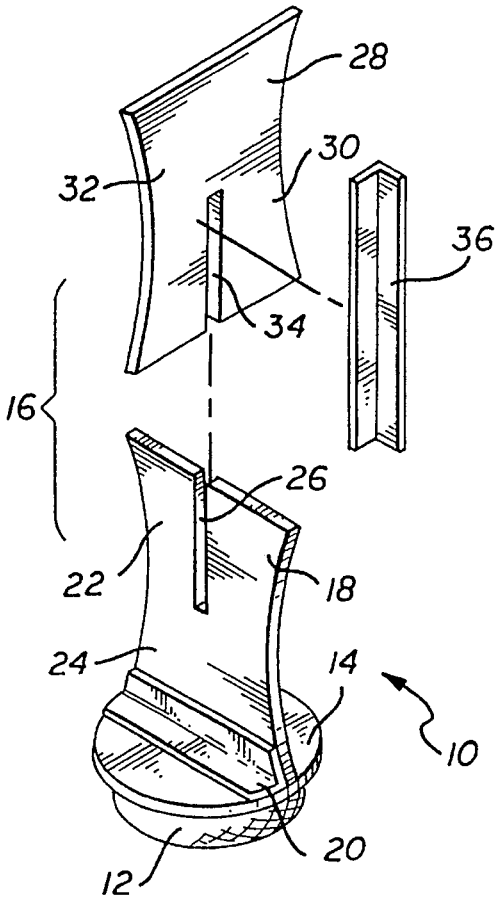
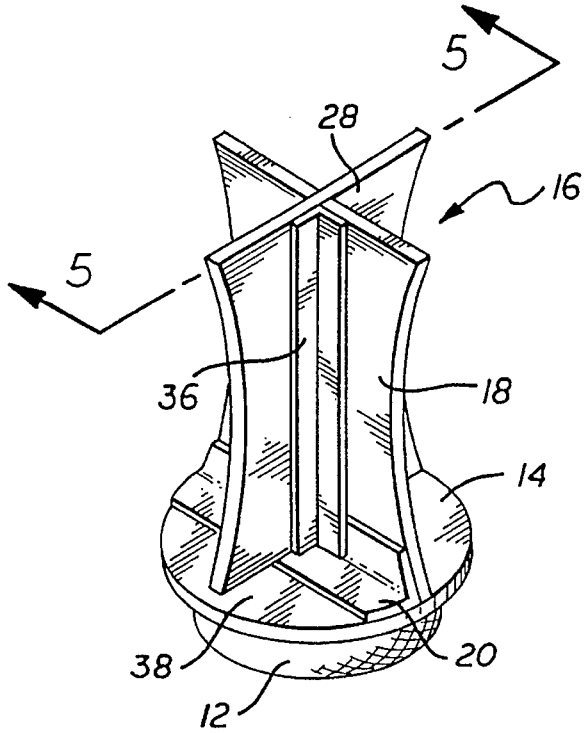
FIG. 2
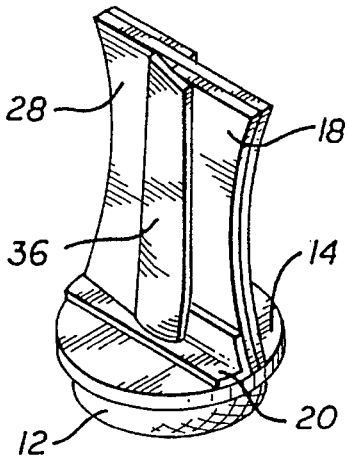
FIG. 3

DISPOSABLE APPLICATOR

BACKGROUND OF THE INVENTION

1. Field of the Invention

The present invention relates to applicators for chemical compounds and, more specifically, to a single-use, disposable, hand-held applicator having a collapsible handle and a pad impregnated with wax, shoe polish, medicines or other chemical compounds.

2. Description of The Prior Art

U.S. Pat. No. 5,112,152, issued to McBride, relates to an applicator and package combination for a single-use application of shoe polish. With reference to the drawings of the McBride patent, the applicator 74 includes a swab 76 and an applicator rod 78. The applicator is contained within a package 70 having a sealed chamber containing liquid shoe polish. The swab 76 protrudes into the sealed chamber, while the applicator rod 78 extends out of the sealed chamber so that a user can grasp the rod to remove the applicator from the sealed chamber without coming into contact with the shoe polish.

Unfortunately, the McBride arrangement is somewhat messy. Shoe polish is particularly difficult to remove from clothing and carpeting, and it is desirable to eliminate the possibility of polish spills. However, polish may spill out of the McBride package once the applicator has been removed, and when the package is otherwise pierced.

Additionally, since the unit holding the polish and the applicator are separate pieces, the user must occasionally dip the applicator into the package to reinfuse the swab with polish, thereby increasing the risk of a polish spill. Furthermore, there is no barrier between the swab and the rod once the user has removed the applicator from the packaging. Consequently, the user's fingers can get messy during use.

U.S. Pat. No. 4,077,725, issued to Slauterback, discloses a shoe polish applicator having a reusable handle 12 and a disposable polish pad 11. Because the Slauterback handle is not disposable, the Slauterback applicator is not well-suited to the user who wants to use the applicator only once. For instance, a traveller arriving at an airport may need to purchase a shoe polish applicator at a vending machine to quickly polish her or his shoes before a business meeting. The reusable handle would make the Slauterback applicator too expensive to sell in a vending machine and, in any event, the traveller would not want to carry the non-disposable handle to the business meeting.

Additionally, the angle of the Slauterback pad relative to the handle cannot be adjusted to allow the pad to get to hard-to-reach tight spots.

Various other applicators have been proposed, such as those disclosed in U.S. Pat. Nos. 5,020,930, 5,242,232, 5,188,472, 4,715,496, and 4,708,507. However, none of these applicators are disposable and none provide for adjusting the angle of the pad relative to the handle. Additionally, these applicators lack adequate barriers between the handle and the polish in order to protect the hand and fingers from being stained during use.

SUMMARY OF THE INVENTION

Broadly considered, an applicator for applying waxes, polishes, medicines and chemical compounds according to the present invention has a base piece, a pad attached to the base piece and a handle. The handle is connected to the base piece with a hinge. The base piece and pad may swivel about the hinge to follow the contour of a surface, and the handle may fold about the hinge for compact storage.

The present invention is helpful in overcoming the shortcomings of the prior art in a number of ways. First, the applicator may be made of inexpensive, lightweight material so that the applicator is disposable after one use. Second, the applicator may have a simple construction that is inexpensive to make. Third, the base piece provides a barrier between the user's fingers and the pad, which is typically impregnated with chemicals, thereby reducing mess and contact with potentially irritating chemicals.

Fourth, the pad may be pre-impregnated with a variety of different chemical compounds, so that a separate container for chemical compounds is not required. The applicator and the supply of chemical compound are therefore combined in one fully integrated, ergonomic, contiguous unit, with the positive environmental effect of eliminating extra packaging that would otherwise need to be thrown away.

Fifth, to further reduce mess, the pad may be wrapped in a removable foil wrapper, non-porous film or fluid impermeable paper prior to use.

Continuing to consider the present invention in somewhat more detail, the handle may have one or more handle pieces that collapse substantially together to further reduce the size of the applicator for storage in packaging prior to sale. Alternatively, the handle pieces may collapse only partially together in order to adjust to the size of the user's fingers. In this sense, at least some of the embodiments of the applicator are ergonomic. Additionally, there may be a slight gap between at least one of the handle pieces and the base piece to provide clearance for the base piece to swivel about the hinge during use.

Other objects, features, and advantages of the invention will become apparent from a consideration of the following detailed description and the accompanying drawings.

BRIEF DESCRIPTION OF THE DRAWINGS

FIG. 1 is a partial exploded view of an embodiment of an applicator in accordance with the present invention;

FIG. 2 is a perspective view of the applicator of FIG. 1 in an upright configuration and ready to be used;

FIG. 3 is a perspective view of the applicator of FIG. 2 with the first and second handle pieces being collapsed together almost within the same plane;

DETAILED DESCRIPTION OF THE PREFERRED EMBODIMENTS

Figure 4:
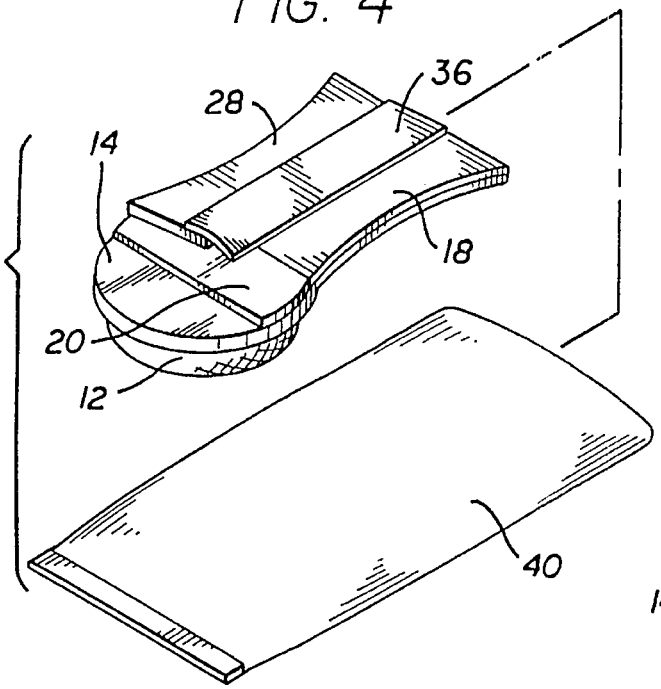
FIG. 4 is a perspective view of the applicator of FIG. 2, with the handle folded flat against the base piece and with a package in which the applicator may be sold.
Figure 5:
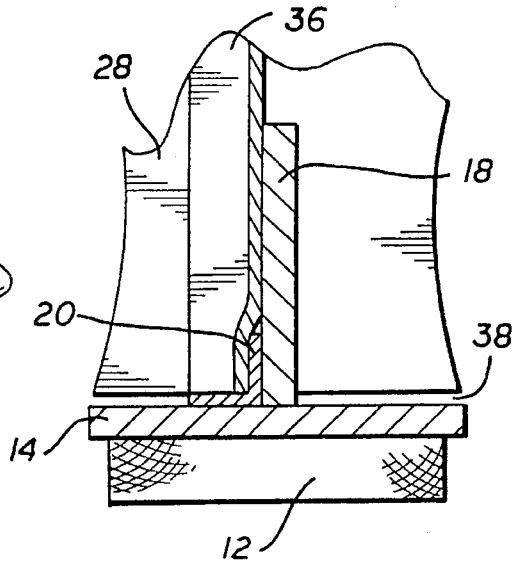
FIG. 5 is a cross-sectional view of the applicator taken about Line 5—5 of FIG. 2.

The following is a detailed description of a preferred embodiment of the present invention. The first portion of this detailed description describes the structure of the preferred embodiment. The second portion describes exemplary materials and dimensions that may be used to construct the preferred embodiment. The third portion describes a few of the many variations that may be made to the preferred embodiment.

THE STRUCTURE OF THE PREFERRED EMBODIMENT

Referring more particularly to the drawings, FIG. 1 is a partial exploded view of an applicator 10. The applicator 10 includes a disc-shaped, chemically-impregnated foam pad 12 that is attached to a disc-shaped base piece 14 with an impermeable adhesive. The base piece 14 has a greater diameter than the pad 12, to act as a shield to protect a user's fingers from the chemicals or the pad. A handle 16 has a first handle piece 18 that is hingedly connected to the base piece 14 by a hinge 20, which may be a piece of adhesive tape or another type of mechanical hinge. The handle piece 18 has an upper portion 22 and a lower portion 24. A centrally located slot 26 having an opening at the uppermost edge of the first handle piece 18 extends vertically down the center of the upper portion 22. The slot 26 stops where the lower portion 24 begins.

A second handle piece 28 has a lower portion 30 and an upper portion 32. A slot 34 having an opening at the lowermost edge of the second handle piece 28 extends vertically up the center of the lower portion 30. The slot 34 stops where the upper portion 32 begins. Both of the handle pieces 18, 28 have curved edges.

The handle 16 is assembled by aligning the slots 26 and 34 and sliding the second handle piece 28 down over the first handle piece 18. When the handle 16 is assembled (FIG. 2), the slot 34 extends vertically down the center of the lower portion 24 of the first handle piece 18. Likewise, the slot 26 extends vertically up the center of the upper portion 32 of the second handle piece 28.

FIG. 2 illustrates the handle 16 after it has been assembled. A strip of adhesive tape 36 may optionally be adhered longitudinally upon the two pieces of the handle to further interconnect the two handle pieces and to stabilize the handle. It should be noted that the two pieces of the handle may be embossed in order to provide a firmer grip on the handle and to minimize slippage of the fingers holding the handle.

The sum of the lengths of the first slot 34 and the second slot 26 may be less than the length of the first handle piece 18, so as to leave a swivel gap 38 between the second handle piece 28 and the base piece 14. The swivel gap 38 permits the base disc 14 and the pad 12 to swivel or "float" about hinge 20, so as to track the contour of the surface being polished.

An advantage of this handle construction is that handle 16 may collapse, as FIG. 3 illustrates. That is, the line segment defined by the slot 34 and the slot 26 serves as an axis of rotation. The second handle piece 28 may rotate about the axis of rotation, from the fully open position of FIG. 2, in which the first and second handle pieces 18, 28 extend perpendicularly to one another, to the fully collapsed position of FIG. 3, in which the handle pieces extend almost within the same plane.

Figure 6:
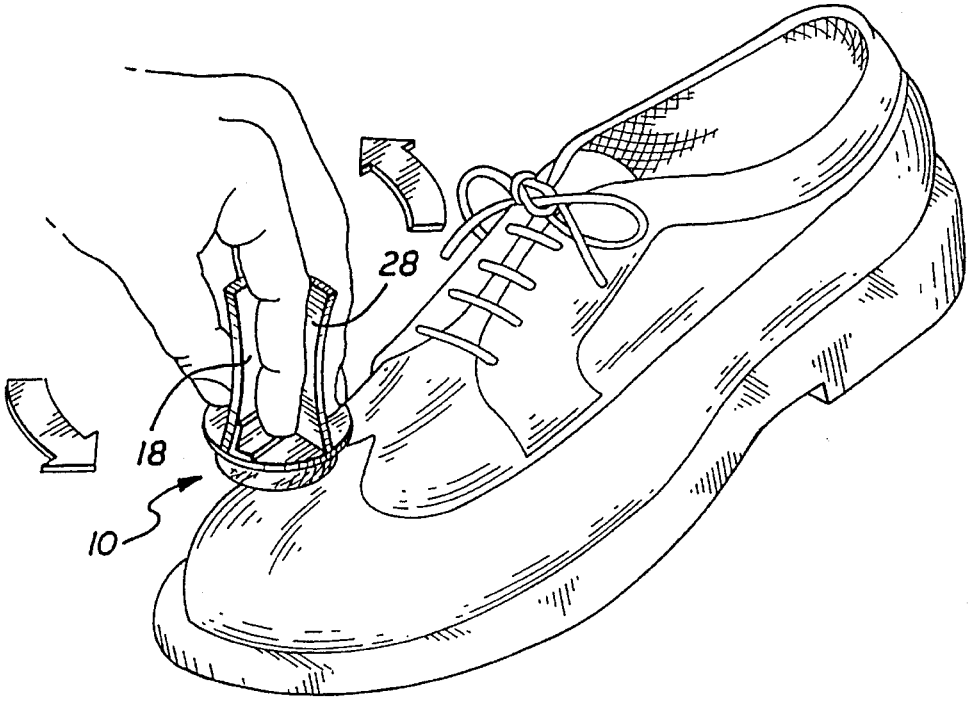
FIG. 6 is a perspective view of a user applying shoe polish to a shoe with an embodiment of the present applicator.

The second handle piece 28 may also rotate to a lesser extent than the fully collapsed position of FIG. 3, in order to adjust to fit the size of a user's fingers when the user is grasping the handle. FIG. 6 shows the applicator 10 being used to polish a shoe, with a user placing his fingers between the handle pieces 18 and 28. The pair of arrows indicates that the applicator base piece swivels with the contour of the shoe.

Once the handle 16 has been collapsed as in FIG. 3, the user may fold the handle 16 about hinge 20 as FIG. 4 shows. The handle 16 folds onto a portion of the upper surface of the base piece 14, with the folded handle 16 extending radially from the center of the base piece 14. The collapsed and folded handle of FIG. 4 is ideal for packaging, such that the applicator is compact and relatively flat and may be packaged in plastic package 40 or a thin box.

The applicator is sold flat as in FIG. 4 within the packaging 40. The packaged applicator takes up substantially less space than the fully assembled applicator of FIG. 2, and is well suited for vending machine sales. Once the folded applicator of FIG. 4 is removed from the plastic packaging, the user prepares the applicator for use by rotating the handle 16 by 90 degrees to the position of FIG. 3, then rotates the second handle piece 28 into the open position of FIG. 2.

It should be noted that terms such as "upper" and "lower" are used relative to what is "upper" and lower in the accompanying drawings. However, the applicator will be moved about during use, and what is "upper" in the drawings may become "lower" during use, and vice-versa. Consequently, relative terms such as "upper" and "lower" are not absolute terms, but are used to illustrate relative positions.

EXEMPLARY MATERIALS AND DIMENSIONS

The handle 16 and base piece 14 may be made from a stiff cardboard, which has several advantages. Cardboard is inexpensive, lightweight and sufficiently durable for a single-use applicator. Alternatively, the handle and base piece may be molded plastic, which is somewhat more durable and stiffer than cardboard and may also be used for alternative embodiments in which the applicator is reusable.

The following dimensions are given for purposes of illustrating one preferred embodiment, and should not be viewed as limiting. The base piece 14 may be a circular disc having a diameter of 1½" inches. The two handle pieces may be 1½" inches wide at the base, with the handle piece 18 being 2 inches long and the handle piece 28 being 1⅞" long. The slot 26 may be 1 inch long, while the slot 34 may be ⅞" long in order to produce a swivel gap 38 of ⅛" with the upper ends of the handle pieces 18 and 28 being flush.

The presently preferred pad 12 is sturdy enough to generally retain its shape during use, but is also flexible enough so as to at least partly conform to the shape of the shoe surface. The foam pad 12 may be a fine cell ester, such as that which is available from PAC Foam Products Corporation of Costa Mesa, Calif., or other similar foams. The color of the foam pad 12 may be chosen to match the color of the polish with which the foam pad 12 is impregnated. Thus, a consumer may determine the color of the polish with a quick look at the foam pad 12.

However, the preferred embodiment of applicator 10 is intended to apply a polish with no particular coloring, for the purpose of shining any color of shoe. The color of the foam pad 12 for this preferred embodiment may be white or yellow to indicate to a consumer that the polishing compound impregnated in the foam pad 12 is compatible with all shoe colors.

The foam pad 12 is typically ⅜" to ½" thick and has a diameter of approximately 1¼" inches. The foam pad 12 is preferably wrapped in a foil wrapper, non-porous film or fluid impermeable paper prior to sale so as to prevent the polish from drying out prior to use and to protect those who handle the product from getting messy.

The applicator 10 may be employed for a variety of purposes. The foam pad 12 is typically impregnated with a wax, a polish and/or other chemical compounds, such as shoe shine compounds, ski wax, facial make-up or medicine.

The preferred embodiment of the present invention carries a shoe polish that will shine shoes without coloring the shoes. Chemicals to add shine to the shoe are impregnated into the matrix of the foam material, and are released onto the surface of the shoe when the pad is pressed against the shoe.

The preferred polish will be rigid in appearance, but easily disrupted by touch, having the character of a thixotropic material. The polish may be an "A" grade petrolatum such as that sold under the trade name "White Fonoline", manufactured by the Witco Chemical Co, a division of Sonneborn of New York, N.Y., or any other similar petrolatum. A carnauba wax may be added for additional shine as well as rigidity. Carnauba wax is available from Strahl and Pitsch, West Babylon, N.Y. and the Frank Ross Co., Jersey City, N.J.

Since the polish will typically be insoluble to water and alcohol, the manufacturer may coat the foam pad 12 using a known melt and hot spray process. Environmental laws permitting, the manufacturer may alternatively apply the chemical compounds to the-foam pad with a process employing a solvent such as Ligroin.

VARIOUS ALTERNATIVE EMBODIMENTS

It is to be understood that the foregoing detailed description and the accompanying drawings illustrate the preferred embodiments of the invention. However, various changes and modifications may be made without departing from the spirit and scope of the invention. For example, the pad 12 may be made of a material other than an open-cell foam, such as cotton or other fabric. Furthermore, while the pad 12 is typically disc-shaped, the pad may alternatively be rectangular, triangular, spherical or another shape.

In use, the handle 16 will typically be in approximately the configuration that FIG. 2 illustrates, although the second handle piece 28 may pivot slightly relative to first handle piece 18 to adjust to the size of a user's fingers. Swivel gap 38 allows the base piece 14 to swivel about hinge 20 during use. However, when polishing a highly contoured surface, it may be preferable to use the applicator with the handle collapsed as FIG. 3 illustrates, thereby allowing the foam pad 12 and the base piece 14 to freely swivel about hinge 20 without hitting the bottom of handle piece 28 at steep angles.

The first handle piece 18 and the second handle piece 28 are typically interconnected with one another with the slot arrangement that FIGS. 1–3 illustrate. However, the handle pieces 18 and 28 may be collapsibly interconnected with various other types of hinges, including durable metal hinges for reusable embodiments of the present invention.

The handle 16 may nave more than two handle pieces. For example, a handle could be made of several handle pieces hinged together with pieces of adhesive tape or other types of hinges. Alternatively, the handle 16 may be made of a single handle piece hingedly attached to the base piece.

The handle pieces and the base piece are preferably made of stiff cardboard or light plastic. Alternatively, these pieces may be made of other materials, such as wood, hard rubber or durable plastic, particularly for alternative embodiments designed to be used for more than a single application.

The applicator 10 may come in various sizes. The embodiment described in the detailed description is a presently preferred embodiment of a shoe polish applicator for vending machine sales. Alternatively, the applicator 10 may be provided in larger sizes for other applications, such as applying paint or furniture polish.

The base piece 14 protects the user's fingers from contact with the chemical compounds that are impregnated into the pad 12. When extra protection from such contact is desired, the base piece 14 may have dimensions somewhat greater than the width or diameter of the pad 12. Although the base piece 14 is shown as a disc, it may be any of a variety of other shapes.

The first handle piece 18 is typically hingedly connected to the base piece 14 with a simple hinge, such as a piece of adhesive tape. Alternatively, other types of mechanical hinges may be used, particularly if a multi-use applicator is desired. As a further alternative, the handle piece 18 may be integral to base piece 14. For instance, handle piece 18 and base piece 14 may be a single molded plastic unit, with the plastic being particularly thin where the handle piece 18 meets base piece 14 to form what is functionally a hinge.

Swivel gap 38 may be eliminated by increasing the length of slot 26 and/or 34. The base piece 14 and pad 12 would then be stationary in that the second handle piece 28 would prevent swiveling. One or more nubs or detents may be provided on the upper surface of the base piece so that one or both of the handle pieces may "click" into place.

Accordingly, the present invention is not limited to the embodiments shown in the drawings or described in detail hereinabove.

What is claimed is:

1. A disposable, hand-held, single-use applicator for applying waxes, polishes, medicines, and chemical compounds comprising:

a base disc having an upper surface and a lower surface;

a disc-shaped, chemically-impregnated pad attached to said lower surface of said base disc; and a handle comprising a first handle piece that is hingedly attached to said upper surface of said base disc, said first handle piece having an upper portion, said handle piece having a slot defined in the upper portion thereof, and a second handle piece having a lower portion, said second handle piece having a slot defined in the lower portion thereof;

wherein said first handle piece and said second handle piece are collapsibly interconnected with one another such that said slot in said second handle piece overlaps a portion of said first handle piece and said slot in said first handle piece overlaps a portion of said second handle piece, and wherein said handle pieces may be folded together onto said base piece.

2. A disposable applicator as defined in claim 1, wherein the sum of the lengths of said first handle piece slot and said second handle piece slot is slightly less than the length of said first handle piece, thereby providing a swivel gap in between said second handle piece and said base disc.

3. A disposable applicator as defined in claim 1, wherein said pad is foam and is between approximately ⅜" and ½" thick.

4. A disposable applicator as defined in claim 1, wherein said first and second handle pieces are made of a substantially rigid plastic.

5. A disposable applicator as defined in claim 1, wherein said first and second handle pieces and said base disc are made of sturdy cardboard.

6. A disposable applicator as defined in claim 1, wherein said first handle piece is hingedly attached to said base piece with adhesive tape.

7. A disposable applicator as defined in claim 1, wherein said applicator further comprises a piece of adhesive tape, said piece of tape longitudinally connecting said first and second handle pieces.

8. A disposable applicator as defined in claim 1, wherein said pad is enclosed in a fluid-impermeable wrapper.

9. An applicator as defined in claim 1, wherein said first and second handle pieces have a normal position in which said first and second handle pieces intersect substantially perpendicularly to one another, and an in-use position in which said second handle piece rotates relative to said first handle piece in order to adjust said handle to the size of a user's fingers for comfort during use.

10. An applicator as defined in claim 1, wherein there is a swivel gap in between said second handle piece and said base disc.

11. An applicator as defined in claim 1, wherein an adhesive tape attaches said pad to said base disc.

12. An applicator comprising:

a base piece having an upper surface;

a pad attached to said base piece;

an applicator handle comprising a first handle piece and a second handle piece;

a first handle hinge, said applicator handle being connected to said base piece at said first handle hinge, said first handle hinge having a hinge axis extending along said upper surface of said base piece; and a second handle hinge having a hinge axis extending perpendicularly to the hinge axis of said first handle hinge;

wherein said applicator has a collapsed configuration in which said handle lies down on said upper surface of said base piece; and wherein said applicator also has an upright configuration in which said handle stands upright on said upper surface of said base piece, having been rotated upwardly from said closed configuration about said first handle hinge, with said hinge axis of said second handle hinge being normal to said upper surface of said base piece, and in which said second handle piece has been rotated about said second handle hinge relative to said first handle piece.

13. An applicator as defined in claim 12, wherein the second handle piece is detachable from the first handle piece.

14. An applicator as defined in claim 12, wherein the first handle piece has a slot therein, and wherein said second handle piece fits into the slot to interconnect the first and second handle pieces.

15. An applicator as defined in claim 14, wherein the second handle piece also has a slot, and the first and second handle pieces intersect one another at the slots.

16. An applicator as defined in claim 12, wherein there is a swivel gap between the second handle piece and the upper surface of the base piece to provide clearance for the base piece to swivel relative to the handle during use, the swivel gap comprising an open space between the second handle piece and the upper surface of the base piece.

17. An applicator as defined in claim 12, wherein the first hinge is a piece of adhesive tape.

18. An applicator as defined in claim 12, wherein the second hinge is a piece of adhesive tape.

19. An applicator as defined in claim 12, wherein the handle detaches from the base piece.

20. A method for assembling and using a collapsible applicator to apply any of a variety of chemical compounds, including medicines, polishes and other compounds, to a surface, comprising the steps of:

providing an applicator as defined in claim 12;

placing the handle into an upright position atop the base piece;

once the handle is in the upright position atop the base piece, rotating the second handle piece about the second handle hinge to fully open the handle;

after rotating the second handle piece about the second handle hinge, grasping the handle and applying a chemical compound to the surface.

21. An applicator for applying any of a variety of chemical compounds, including medicines, polishes and other compounds, comprising:

a base piece that has an upper surface;

a pad that is attached to the base piece;

an applicator handle;

a first handle hinge that connects the applicator handle to the base piece, the first handle hinge having a hinge axis that extends along the upper surface of the base piece; and a second handle hinge that has a hinge axis that extends perpendicularly to the hinge axis of the first handle hinge;

wherein the applicator has a first, collapsed configuration in which the handle lies down on the upper surface of the base piece; and wherein the applicator has a second, upright configuration in which the handle stands upright on the base piece, with the axis of the second handle hinge extending vertically upwardly from the upper surface of the base piece.

22. An applicator as defined in claim 21, wherein the handle detaches from the base piece.

23. A method of using an applicator, the method comprising the steps of:

providing an applicator as defined in claim 21, with the applicator being in the first, collapsed configuration;

rotating the handle about the first handle hinge from the first, collapsed position into the second, upright position; and after the step of rotating the handle into the second, upright position, rotating the handle about the second handle hinge to maintain the handle in the second, upright position.

24. An applicator comprising:

a base piece;

a pad attached to said base piece; and a handle comprising a first handle piece and a second handle piece;

wherein said handle is mounted on said base piece, and said first and second handle pieces are collapsibly interconnected with one another such that said second handle piece may be rotated against said first handle piece for compact storage; and wherein said first and second handle pieces have a normal position in which said first and second handle pieces intersect substantially perpendicularly to one another, and an in-use position in which at least said second handle piece rotates relative to said first handle piece in order to adjust to the size of a user's fingers for comfort during use.

* * * * *